US007609224B2

(12) United States Patent
Watson, III

(10) Patent No.: US 7,609,224 B2
(45) Date of Patent: Oct. 27, 2009

(54) REDUCING WIND LOADS ON MONOPOLES TO PROVIDE INCREASED CAPACITY WITHOUT STRUCTURAL REINFORCEMENT

(76) Inventor: Thomas B. Watson, III, 1036 Chandelle Lake Dr., Pensacola, FL (US) 32507

( * ) Notice: Subject to any disclaimer, the term of this patent is extended or adjusted under 35 U.S.C. 154(b) by 787 days.

(21) Appl. No.: 11/101,956

(22) Filed: May 23, 2005

(65) Prior Publication Data

US 2007/0095551 A1 May 3, 2007

(51) Int. Cl.
*H01Q 1/12* (2006.01)

(52) U.S. Cl. ..... 343/878; 343/890; 52/835; 52/849

(58) Field of Classification Search ..... 343/874, 343/875, DIG. 1, 878, 880, 890, 873, 883; 52/110, 834, 835, 848, 849
See application file for complete search history.

(56) References Cited

U.S. PATENT DOCUMENTS 2,016,011 A * 10/1935 Kent ..... 52/292
6,453,636 B1 * 9/2002 Ritz ..... 52/736.4

* cited by examiner

*Primary Examiner*—Michael C Wimer
(74) *Attorney, Agent, or Firm*—Kenneth W. Float

(57) ABSTRACT

Apparatus and methods that reduce wind loads on polygonal monopoles, such as antenna towers and other telecommunication structures, exposed to winds. A multiplicity of connected segmented truncated conical shrouds are attached along at least a portion of the length of a polygonal monopole (telecommunication structure or antenna tower) that surround it. The presence of the multiplicity of segmented conical shrouds changes the profile of the monopole from multi-sided or faceted polygonal to conical. Based on the specifications of the TIA/EIA-222-F which is the governing code for telecommunication structures, the reduction of the wind load on a 12-sided polygonal monopole is on the order of about 42 percent, on a 16-sided polygonal monopole is on the order of about 18 percent, and on a 18-sided polygonal monopole is on the order of about 9 percent.

20 Claims, 3 Drawing Sheets

REDUCING WIND LOADS ON MONOPOLES TO PROVIDE INCREASED CAPACITY WITHOUT STRUCTURAL REINFORCEMENT

BACKGROUND

The present invention relates to systems and methods for reducing wind loads on monopoles, such as telecommunication structures or antenna towers, for example.

Tall antenna towers are typically constructed as multi-sided polygonal structures, typically having on the order of eight to eighteen sides. When exposed to high winds, such antenna towers experience high wind loads, and often times require reinforcement to keep them from becoming over-stressed per government structural codes.

A common conventional approach to structural reinforcement of an antenna tower welds multiple reinforcing members along the length of the tower. This conventional approach is very expensive, costing on the order of $1000 per foot for a typical antenna tower.

It has been common to retrofit polygonal steel monopole towers to add additional antenna carriers. The retrofit schemes that are currently used in the tower industry are common in one major respect: they are reinforcement methods. In order to accommodate the additional carriers, the structural capacity of the tower is increased, either by augmenting individual components or by adding external structures to support the existing tower while sustaining higher loads.

Wind loading governs the design of all steel antenna-supporting structures as per the TIA/EIA-222-F, which is the commonly accepted standard. The tower profile determines the drag force coefficient, which is linearly proportional to the wind load.

A number of US patents and patent applications relate to telecommunication structures, such as antenna towers and poles, which are discussed below.

U.S. Pat. No. 1,732,690 discloses "devices designed to rotatably support loop antennas." (see Abstract)

U.S. Pat. No. 3,958,381 discloses a "Concrete filled tapered tubular tower" (Title).

U.S. Pat. No. 5,060,435 discloses a "Bracket for support of a vertical pole" (Title).

U.S. Pat. No. 6,028,566 discloses "an aerial tower 15, also referred to as a monopole or simply a pole is shown which at a lower end is typically mounted upon a footing that is located adjacent to a shelter that contains radio frequency for RF equipment associated with wireless communication networks. The aerial tower 15 may be of any conventional design at least including hollow tubular steel columns 17 through which communication wiring is housed between a top end and lower end of the tower 15 and self supporting and guyed towers." (see Abstract)

U.S. Pat. No. 6,131,349 discloses with reference to FIGS. 10 and 11, "an enclosure and antenna tower support unit in accordance with the invention is illustrated and generally designated by the numeral 320. The enclosure unit 320 includes an enclosure 224 supported on a support base 222 on which a generally rectangular reinforcing deck plate 322 is suitably secured, such as by welding. Support base 222 is modified slightly to include longitudinal intermediate beams 70c, see FIG. 11 also, which are of generally rectangular tubular cross sectional configuration. Spaced apart bolt stiffening and support plates 324 extend between the beams 70c and are suitably welded thereto and to form supports for elongated studs or bolts 326, FIG. 11, which are operable to be connected, as shown, to a generally cylindrical base member 328 of a tubular, polyhedral cross section, tapered monopole type tower 330 of a type known in the art for supporting floodlights, electrical transmission lines and other items requiring elevation above ground level. Suitable communications antenna 43a may, of course, be mounted on the tower 330 in the same manner as the antenna 43a are mounted on the tower 228, for example. Use of the tubular monopole type tower 330 may be preferred in certain applications of telephone and other wireless communications equipment in the interest of reduced costs and weight." (see column 8, line 61 to column 9, line 17)

U.S. Pat. No. 6,222,503 discloses "System and method of integrating and concealing antennas, antenna subsystems and communications subsystems" (Title).

U.S. Pat. No. 6,256,961 discloses a "Utility pole base construction" (Title).

U.S. Pat. No. 6,322,863 discloses a "Utility pole with pipe column and reinforcing rods comprised of scrap rubber and plastic" (Title).

U.S. Pat. No. 6,446,408 discloses a "Collapsible pole", and more particularly an "apparatus and method for elevating items includes telescopically retractable and extendable hollow tubular pole sections that include a locking means to lock at least one section in extended position. The bottom of the pole is adapted for mounting to a support structure." (see Abstract)

U.S. Pat. No. 6,453,636 discloses a "support structure for use with an existing single pole tower. The single pole tower has a pole anchored to a foundation and supports a first load. The support structure has a number of sleeves surrounding the pole. A first one of the sleeves is anchored to the foundation. A second load is attached to a second one of the sleeves." (see Abstract)

U.S. Pat. No. 6,694,698 discloses "Reinforcement apparatus for monopole towers" and more particularly, "a reinforcement apparatus forming an exo-skeleton of tubular steel rods and adjustable mounting clamps directly in contact with the exterior of previously erected tapered wireless communication monopole towers to provide additional strength and resistance against deflection due to wind forces and additional weight thereby enabling the placement of more antenna arrays and communication instruments thereon." (see Abstract)

US Patent Application No. 2002/0140623 discloses that an "existing monopole is strengthened to accommodate loading associated with additional elements included in over-the-air communications systems by placing expanding foam and aggregate, light weight aggregate concrete, normal weight aggregate concrete or other types of fill material into the hollow bore in the interior of the monopole. Monopole strengthening may require base plate strengthening, adding anchor bolts and/or foundation strengthening. This permits an existing monopole to accommodate more elements than were initially envisioned when the monopole was initially erected." (see Abstract)

US Patent Application No. 2003/0000165 discloses an "precast post-tensioned segmental pole system capable of supporting a load is provided. The pole system includes a plurality of pole segments that use connectors and strands to anchor them together. The strands extend within a cavity formed in the pole segments and are external to the wall structure of the pole segments. The strands may be coupled between both of the pole segments, or be anchored to a connector. The connector includes an upper piece that is coupled to one pole segment, and a lower piece that is coupled to the other pole segment. Upper and lower pieces interlock with each other to join the pole segments to one another. The strands are placed in tension so that pole system is capable of withstanding forces imposed by the load." (see Abstract)

US Patent Application No. 2003/0026923 discloses an "integrated, monopole reinforcement sleeve system for the reinforcement of self-supporting monopoles at select, predetermined locations. The integrated, monopole reinforcement sleeve system is composed of at least one pair of complementary hemi-sleeves and a non-slip filler, wherein the filler is inserted between the sleeves and the monopole. The sleeves are tightened around the monopole, thereby providing integrated monopole reinforcement. A method for the reinforcement of monopoles with an integrated reinforcement sleeve is also described." (see Abstract)

US Patent Application No. 2003/0033281 discloses a "support structure for use with an existing single pole tower. The single pole tower has a pole anchored to a foundation and supports a first load. The support structure has a number of sleeves surrounding the pole. A first one of the sleeves is anchored to the foundation. A second load is attached to a second one of the sleeves." (see Abstract)

US Patent Application No. 2004/0020158 discloses a "tower reinforcement apparatus designed to increase the load capacity and stability of a tower to enable the tower to support the weight of additional communication equipment as well as the environmental forces exerted on the tower. The preferred embodiment generally includes upper and lower collar assemblies disposed about the tower, a plurality of mounting blocks having a flat portion that is secured to an outer surface of the tower and an inner surface of the upper or the lower collar assemblies to secure the collar assemblies to the tower, a plurality of flat bars vertically attached to the upper and the lower collar assemblies, and at least one ring disposed between the collar assemblies, the at least one ring is formed to wrap around the tower and the flat bars in order to hold the flat bars in compression with the tower." (see Abstract)

US Patent Application No. 2004/0070985 discloses a "modular pole system and light fixture is disclosed wherein the modular pole system is comprised of an internal skeletal structure and an external plastic shell. The external plastic shell may slide over the assembled internal skeletal structure and may be comprised of a singular unit. The internal skeletal structure may be comprised of an upwardly extending tapered pole which is held in place by a base and post which also provides a static structure acting as a passive defense mechanism." (see Abstract)

However, none of the above-cited patents or applications disclose or suggest attaching a series of segmented conical sections to a polygonal tower or pole to reduce wind loads. It would be desirable to have a technique for reducing wind loads on antenna towers and monopoles exposed to winds that does not require structural reinforcement of the tower or pole, improves upon conventional techniques and lowers costs of implementation.

SUMMARY OF THE INVENTION

To accomplish the above and other objectives, the present invention provides for apparatus and methods that reduce wind loads on polygonal monopoles, such as antenna towers and other telecommunication structures, exposed to winds. More particularly, the present invention provides for the use of a multiplicity of connected or overlapping segmented truncated conical structures, or shrouds, attached along at least a portion of the length of a polygonal telecommunication structure (antenna tower or monopole) that surround the polygonal telecommunication structure. The presence of the multiplicity of segmented conical structures changes the profile of the telecommunication structure from a multi-sided or faceted polygonally shaped structure to a conically shaped structure. This reduces the wind load on the telecommunication structure. For example, the wind load on an exemplary 12-sided polygonal telecommunication structure is reduced by about 42 percent.

An exemplary method comprises the following steps. A multiplicity of truncated conical sections are fabricated such that each comprise a plurality of segmented pieces that overlap to form a telescoping member, and wherein the telescoping member has an upper fixed joint and a lower telescoping joint, and wherein the multiplicity of truncated conical sections, when overlapped, form an elongated telescoping structure. The multiplicity of truncated conical sections are sequentially overlapped and secured around a polygonal monopole, with the telescoping joint of an upper conical section overlapping an adjacent fixed joint of a lower truncated conical section.

The retrofit mechanism provided by the present invention operates by reducing wind loads caused by profile drag without reinforcing the existing tower or altering its structural behaviour. By enveloping a polygonal tower with a circular veneer that is firmly affixed (yet not rigidly connected, as with a reinforcement) its capacity to support more antenna is increased, although it remains structurally unchanged.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figures 1, 2, 3, 4:
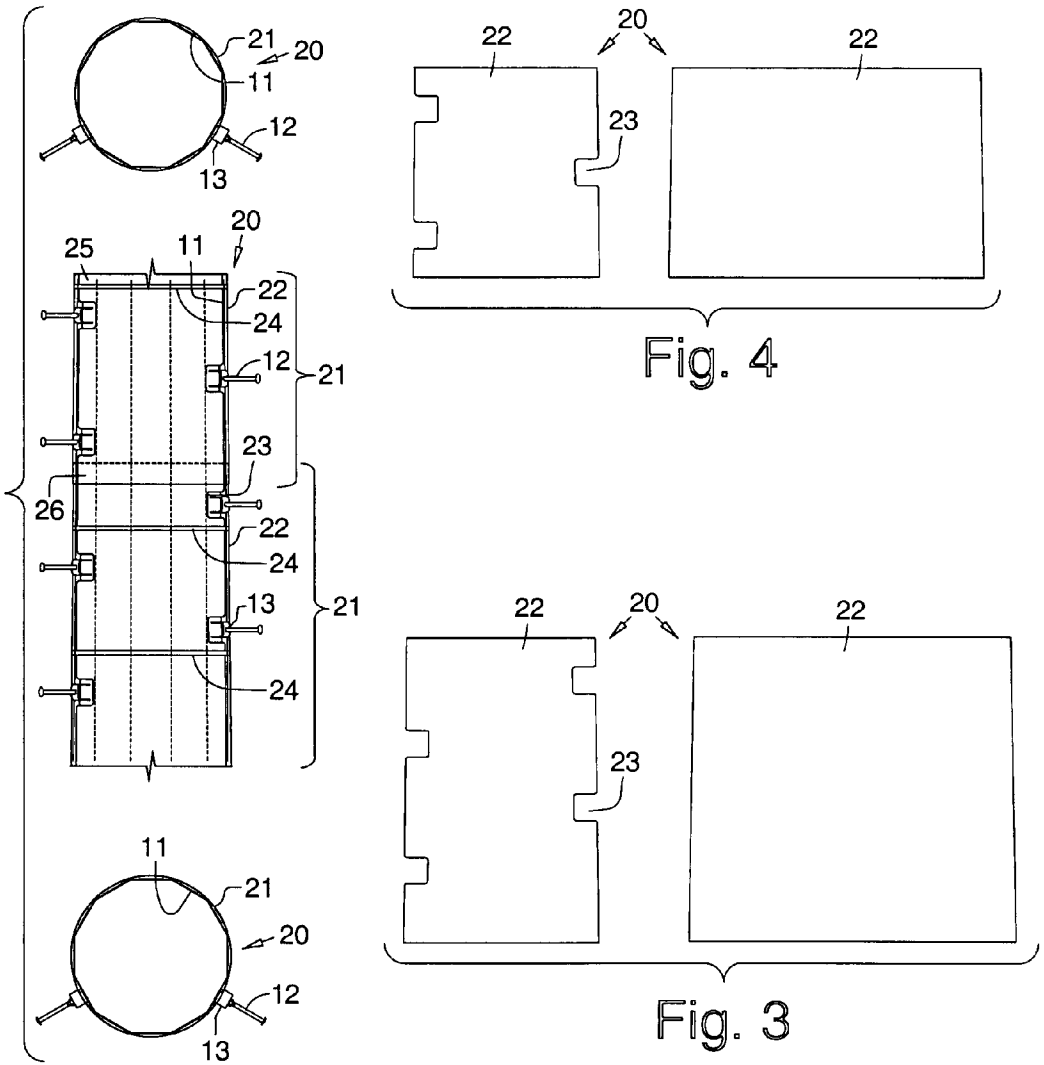
Fig. 1 (PRIOR ART)
FIG. 1 illustrates plan, elevation and bottom views of an exemplary conventional monopole.
FIG. 2 illustrates plan, elevation and bottom views of exemplary load reduction apparatus in accordance with the principles of the present invention employed with the conventional monopole shown in FIG. 1.
FIG. 3 illustrates an exemplary pattern for lower sections of the present load reduction apparatus.
FIG. 4 illustrates an exemplary pattern for upper sections of the present load reduction apparatus.

Referring to the drawing figures, FIG. 1 illustrates plan, elevation and bottom views of an exemplary conventional monopole 10. The exemplary conventional monopole 10 comprises a polygonal monopole 10, such as an antenna tower 10 or telecommunication structure 10, for example. The exemplary monopole 10 is shown as a twelve-sided polygonal structure 10, but it is to be understood the monopole 10 may have any number of sides.

The monopole 10 typically has a height of up to about 200 feet high and is typically tapered. The monopole 10 comprises a vertical pole 11 having a plurality of step bolts 12 disposed therearound that permit scaling of the monopole 10. The step bolts 12 are coupled to brackets 13 attached to the pole 11.

The conventional polygonal monopole 10 experiences a great deal of wind loading. This in part is due to the fact that the conventional polygonal monopole 10 is a polygonal structure 10.

In contrast, the geometric properties of a cone provide an extremely low wind resistance. As a specific example, the coefficient for wind load on a 12-sided polygonal member is 1.03 versus 0.59 for a circular member (from TIA/EIA-222-F, Governing code for Telecommunication Structures).

With this in mind, FIG. 2 illustrates plan, elevation and bottom views of exemplary load reduction apparatus 20 in accordance with the principles of the present invention employed with the conventional polygonal monopole 10. The exemplary wind load reduction apparatus 20 reduces wind loads experienced by a polygonal monopole 10, such as a telecommunication structure 10, antenna tower 10 or pole 10.

FIG. 2 illustrates the exemplary load reduction apparatus 20 installed on conventional monopole 10. FIGS. 3 and 4 illustrate exemplary patterns for lower and upper sections, respectively, of the present load reduction apparatus 20.

The exemplary load reduction apparatus 20 comprises a multiplicity of connected or overlapping segmented truncated conical structures 21, or shrouds 21, disposed along at least a portion of the length of the polygonal monopole 10 (antenna tower 10 or telecommunication structure 10). The multiplicity of connected or overlapping segmented truncated conical structures 21, or shrouds 21, surround the polygonal monopole 10.

Figure 5:
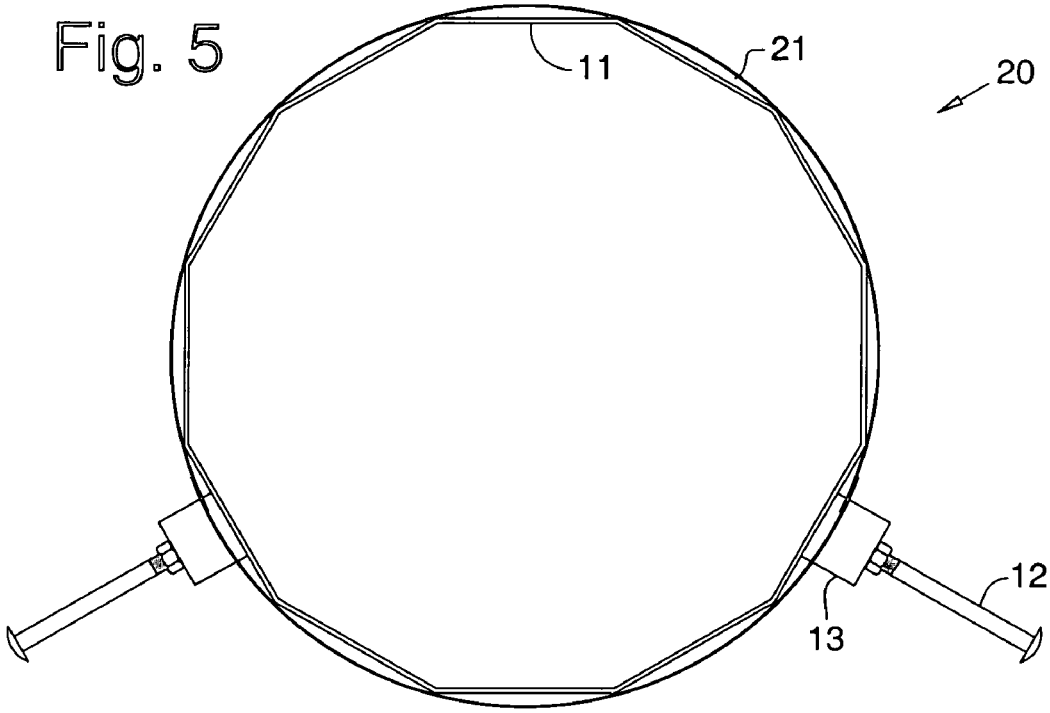
FIG. 5 is an enlarged plan view of the present invention.
Figure 6:
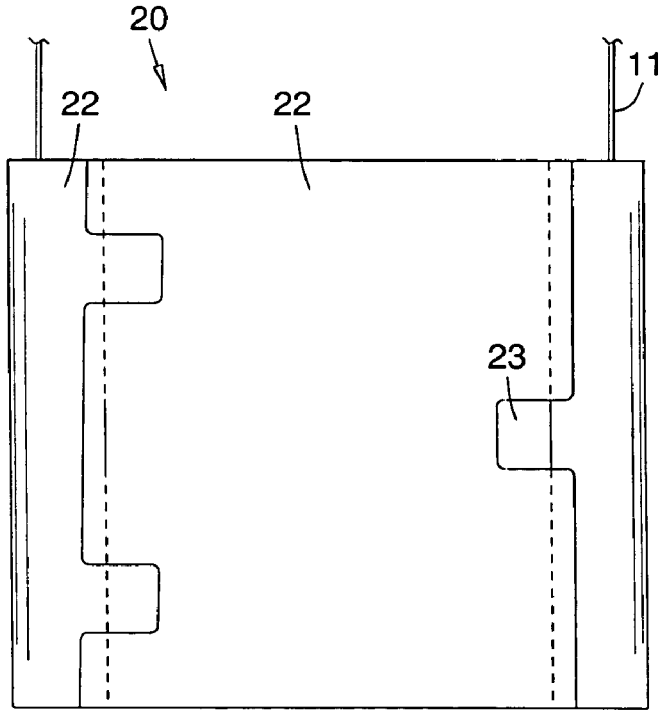
FIG. 6 is an enlarged elevation view of the present invention.

Each of the multiplicity of connected, segmented, truncated conical structures 21 typically comprise a plurality of overlapping pieces 22 (two or three, for example) such as are shown in FIGS. 3 and 4. Enlarged top and side views of the load reduction apparatus 20 are shown in FIGS. 5 and 6, showing a typical overlap. Each of the plurality of pieces 22 may be made of sheet metal, for example, such as from 16-20 gauge stainless steel, for example. The plurality of pieces 22 of a particular conical structure 21 are overlapped around the periphery of the polygonal monopole 10. The plurality of pieces 22 may be secured around the polygonal monopole 10 using a plurality of tension bands 24. The strength requirements of the truncated multi-segmented conical structures 21 used to change the aerodynamics of the monopole 10 are minimal.

As is shown in FIGS. 3 and 4, the respective truncated conical structures 21 typically comprise two or three pieces 22, one or more of which have cutouts 23 into which the brackets 13 that secure the step bolts 12 fit. Each conical structure 21 telescopes from its top to its bottom. A fixed joint 25 is formed at the top of each conical structure 21. A telescoping joint 26 is formed at the bottom of the conical structure 21 overlaps a lower conical structure 21.

As is shown in FIG. 2, the plurality of sections 22 that form the conical structure 21 are secured around the monopole 10 to encase it. The telescoping joint 26 overlaps the lower conical structure 21 to form a relatively smooth outer surface.

The multiplicity of segmented conical structures 21 are disposed along at least a portion of the length of the polygonal monopole 10 and at least partially surround it. The presence of the multiplicity of segmented conical structures 21 changes the profile of the polygonal monopole 10 from a multi-sided or faceted polygonal structure to a conical structure. This reduces the wind load on the polygonal monopole 10 by about 42 percent for an exemplary 12-sided polygonal monopole 10.

At any wind speed, a monopole 10 with a round profile (circular cross-section) has a drag force coefficient of 0.59, while that of a 12-sided polygonal monopole 10 is 1.03. Thus, if the profile alone is changed without altering the structure of the monopole 10, the monopole 10 will carry significantly lower wind loads (a reduction of approximately 42 percent for an unimproved or unaltered monopole 10).

An exemplary approach implemented by the present invention is to use four to eight foot long segments of a truncated conical structure 21 where a 360 degree truncated conical structure 21 is made from two or three overlapping pieces. Each complete section or structure 21 snugly fits around the monopole 10 at its top while its bottom portion provides for a telescoping joint 26 around the conical section or structure 21 below. The entire height of the monopole 10 does not necessarily require this aerodynamic augmentation. However, analysis shows that installation is optimized if the conical sections are always installed from about mid-height to the top of the monopole 10.

Thin gauge stainless steel may be cut to form truncated conical structures 21 that are wrapped around a tapered polygonal monopole 10, overlapping by a small amount as is shown in FIG. 6. Stainless steel ribbon may be used as the tension bands 24 which are tightened to secure the truncated conical structures 21 to the monopole 10, and sheet metal screws may be used to hold the structures 21 together to prevent creep and movement caused by thermal expansion and/or contraction. The taper of the monopole 10 creates a self-stabilizing system as well, in that the farther a conical structure 21 drops, the tighter it becomes.

The presence of the multiplicity of segmented conical structures 21 thus changes the profile of the monopole 10 from a multi-sided or faceted polygonal profile to a conical (circular) profile. This reduces the wind load on the monopole 10. For example, based on the specifications of the TIA/EIA-222-F which is the governing code for telecommunication structures, the reduction of the wind load on a 12-sided polygonal monopole is on the order of about 42 percent, on a 16-sided polygonal monopole is on the order of about 18 percent, and on a 18-sided polygonal monopole is on the order of about 9 percent.

Figure 7:
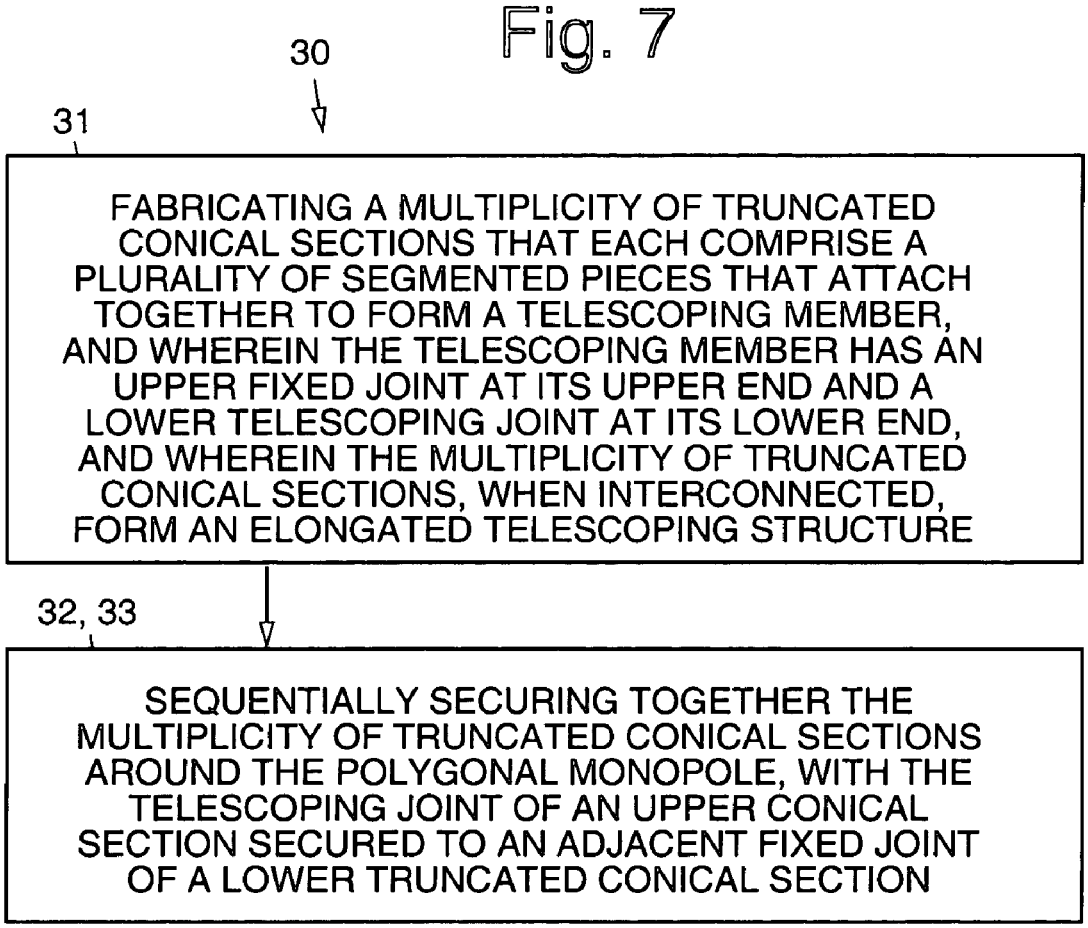
FIG. 7 is a flow diagram illustrating an exemplary method in accordance with the principles of the present invention.

FIG. 7 is a flow diagram illustrating an exemplary method 30 in accordance with the principles of the present invention for reducing wind load on a polygonal monopole 10. The exemplary method 30 comprises the following steps.

A multiplicity of truncated conical sections are fabricated 31 that each comprise a plurality of segmented pieces that overlap each other to form a telescoping member, and wherein the telescoping member has an upper fixed joint and a lower telescoping joint, and wherein the multiplicity of truncated conical sections, when overlapped, form an elongated telescoping structure. The multiplicity of truncated conical sections are sequentially overlapped 32 and secured 33 around the polygonal monopole 10, with the telescoping joint of an upper conical section overlapping an adjacent fixed joint of a lower truncated conical section.

Thus, apparatus and methods for reducing wind loads on monopoles, such as telecommunication structures, have been disclosed. It is to be understood that the above-described embodiments are merely illustrative of some of the many specific embodiments that represent applications of the principles of the present invention. Clearly, numerous and other arrangements can be readily devised by those skilled in the art without departing from the scope of the invention.

What is claimed is:

1. Wind load reduction apparatus for use in reducing wind loads on a polygonal monopole, comprising:

a multiplicity of connected, segmented, truncated conical shrouds that each telescope from top to bottom to encase the monopole without structural connection to a foundation of the monopole and provide a relatively smooth conical outer surface, each conical shroud comprising a plurality of sections that are secured together, each truncated conical shroud comprising a fixed joint formed at its top and a telescoping joint formed at its bottom, and wherein the telescoping joint of an upper truncated conical shroud overlaps the fixed joint of an adjacent lower truncated conical shroud.

2. The apparatus recited in claim 1 wherein the polygonal monopole comprises a telecommunication structure.

3. The apparatus recited in claim 1 wherein the polygonal monopole comprises an antenna tower.

4. The apparatus recited in claim 1 wherein the multiplicity of connected, segmented, truncated conical structures are disposed along at least a portion of the length of the polygonal monopole.

5. The apparatus recited in claim 1 wherein the truncated conical shrouds comprise four to eight foot long segments.

6. The apparatus recited in claim 1 wherein the truncated conical shrouds comprise two sections.

7. The apparatus recited in claim 1 wherein the truncated conical shrouds comprise three sections.

8. The apparatus recited in claim 1 wherein the truncated conical shrouds are installed from about mid-height to the top of the polygonal monopole.

9. The apparatus recited in claim 1 wherein inner surfaces of the multiplicity of truncated conical sections contact the polygonal monopole.

10. A method for reducing wind load on a polygonal monopole, comprising:

fabricating a multiplicity of truncated conical sections that each comprise a plurality of segmented pieces that attach together to form a telescoping member, and wherein the telescoping member has an upper fixed joint at its upper end and a lower telescoping joint at its lower end, and wherein the multiplicity of truncated conical sections, when overlapped, form an elongated telescoping shroud; and sequentially securing together the multiplicity of truncated conical sections around the polygonal monopole, without providing structural connection to a foundation of the monopole, with the telescoping joint of an upper conical section overlapping an adjacent fixed joint of a lower truncated conical section.

11. The method recited in claim 10 wherein the polygonal monopole comprises a telecommunication structure.

12. The method recited in claim 10 wherein the polygonal monopole comprises a antenna tower.

13. The method recited in claim 10 wherein the multiplicity of segmented, truncated conical shrouds are attached along at least a portion of the length of the polygonal monopole.

14. The method recited in claim 10 wherein the truncated conical shrouds comprise four to eight foot long segments.

15. The method recited in claim 10 wherein the truncated conical shrouds comprise two sections.

16. The method recited in claim 10 wherein the truncated conical shrouds comprise three sections.

17. The method recited in claim 10 wherein the truncated conical shrouds are installed from about mid-height to the top of the polygonal monopole.

18. Wind load reduction apparatus for use in reducing wind loads on a polygonal monopole, comprising:

a multiplicity of connected, segmented, truncated conical shrouds that each telescope from top to bottom to encase the monopole and provide a relatively smooth conical outer surface, wherein an inner surface of each truncated conical shroud contacts the polygonal monopole, each truncated conical shroud comprising a fixed joint formed at its top and a telescoping joint formed at its bottom, and wherein the telescoping joint of an upper truncated conical shroud overlaps the fixed joint of an adjacent lower truncated conical shroud.

19. The apparatus recited in claim 18 wherein each conical shroud comprises a plurality of sections that are secured together.

20. The apparatus recited in claim 18 wherein the truncated conical shrouds are installed from a predetermined distance above ground level to the top of the polygonal monopole.

* * * * *